US005967148A

United States Patent [19]

Harris et al.

[11] Patent Number: 5,967,148

[45] Date of Patent: Oct. 19, 1999

[54] LIGHTER ACTUATION SYSTEM

[75] Inventors: Charles W. Harris, Chesterfield; H. Neal Nunnally, Richmond; Robert L. Ripley, Midlothian, all of Va.; Masato Sano, Sumoto, Japan; Barry S. Smith, Hopewell, Va.

[73] Assignee: Philip Morris Incorporated, New York, N.Y.

[21] Appl. No.: 08/951,259

[22] Filed: Oct. 16, 1997

[51] Int. Cl.[6] ..... A24F 1/00; A24F 13/00

[52] U.S. Cl. ..... 131/330; 131/905; 131/906; 131/329

[58] Field of Search ..... 131/329, 330, 131/185, 905, 906

[56] References Cited

U.S. PATENT DOCUMENTS

| | | | |
|---|---|---|---|
| 4,805,641 | 2/1989 | Radzio et al. | 131/280 |
| 4,907,607 | 3/1990 | Focke et al. | 131/280 |
| 5,010,904 | 4/1991 | Lassiter | 131/280 |
| 5,499,636 | 3/1996 | Baggett, Jr. et al. | 131/374 |
| 5,692,291 | 12/1997 | Deevi et al. | 29/611 |

*Primary Examiner*—James Derrington
*Assistant Examiner*—Kevin Cronin
*Attorney, Agent, or Firm*—Charles E. B. Glenn; James T. Moore; Kevin B. Osborne

[57] ABSTRACT

A cigarette identifier system comprising an infrared emitter and an infrared detector located across an opening of a cigarette receiver, wherein the sensor registers changes in the transmission of the infrared beam across the opening so as to detect the differences in transmissivity of dense and less dense and portions of an inserted cigarette.

28 Claims, 10 Drawing Sheets

LIGHTER ACTUATION SYSTEM

FIELD OF INVENTION

This invention relates to electrically powered smoking systems, and more particularly to lighters of electrically powered smoking systems and their actuators which prepare them for operation.

BACKGROUND OF THE INVENTION

Commonly assigned, U.S. Pat. Nos. 5,388,594, 5,505,214, 5,499,636 and 5,591,368 disclose various electrically powered smoking systems comprising electric lighters and cigarettes. The systems provide smoking pleasure while significantly reducing sidestream smoke and permitting the smoker to selectively suspend and reinitiate smoking.

The preferred embodiment of the lighter in U.S. Pat. No. 5,388,594 includes a plurality of metallic serpentine heaters disposed in a configuration that slidingly receives a tobacco rod portion of the system's cigarette. The cigarette and the lighter are configured such that when the cigarette is inserted into the lighter and as individual heaters are activated for each puff, localized charring occurs at spots about the cigarette in the locality where each heater bears against the cigarette (hereinafter referred to as a "heater footprint").

In U.S. Pat. No. 5,388,594, the sequence and the amount of energy applied to each heater element during a puff cycle is regulated by a logic circuit of a controller which executes a power subroutine upon its receiving a signal from a puff sensor. The power subroutine includes the steps of reading the voltage of the power source (batteries) at the initiation of the puff and resolving a shut-off signal in cooperation with a constant Joules energy timer such that the duration of the pulse (its cycle-period) is adjusted relative to the voltage of the power source to provide the same total amount of energy (Joules) throughout the range of voltages of the battery discharge cycle.

Commonly assigned U.S. Pat. Nos. 5,388,594, 5,505,214, 5,499,636 and 5,591,368 disclose cigarette designs including a tubular, tobacco-coated web that releases tobacco smoke constituents when heat is applied to the web. Preferably, the tobacco is coated along the interior of the web, and the web includes an unfilled portion or cavity so as to promote a more complete development of tobacco aerosol. The various forms of cavities (also called gaps and voids) improve delivery in electrically heated cigarettes.

The U.S. Pat. No. 5,499,636 describes an electrical smoking system comprising an electric lighter having a plurality of electrically resistive heaters and a controller, together with a cigarette having a tubular tobacco web which is only partially-filled with cut tobacco shreds so as to define a filled tobacco rod portion and an unfilled tobacco rod portion. Preferably upon full insertion of the cigarette into the lighter, operative portions of heater elements within the lighter partially overlap both the aforementioned filled portion and the unfilled portion of the cigarette rod. With such overlap, an immediate release of tobacco smoke arises from the more readily combusted, unfilled tobacco rod portion so that the smoker receives an immediate response upon initiating a draw. Combustion of the filled tobacco rod portion is slightly delayed and contributes the aromas and taste of the tobacco or blend of tobaccos comprising the filled portion of the tobacco rod. Accordingly, the arrangement provides a smoker aspects of smoking pleasure to which he/she expects from smoking more traditional cigarettes; an immediacy of response and the tastes and aromas of filler tobaccos.

With the system of U.S. Pat. No. 5,499,636, it is important that the internal structures of the cigarette and lighter match so that the desired proportions of heater overlap are achieved. Accordingly, a need has arisen for providing the lighter a capacity to discern whether a cigarette that has been inserted in the lighter has the desired internal structure, particularly as to whether the cigarette includes a cavity within a tubular tobacco web. Further to this need, it is important that the cigarette and lighter of an electrical smoking system be matched so that the desired tastes and predetermined delivery levels are obtained.

The above-commonly assigned U.S. Pat. Nos. 5,388,594, 5,505,214, 5,499,636 and 5,591,368 all disclosed systems which include a cigarette detector signal a logic circuit responsively to an insertion of a cigarette, some of which detectors include optical components. It has been found that lens and other light transmissive components located at or about the heater elements of the lighter are prone to collect dirt and tobacco smoke condensates and become clouded.

It has also been found that optical detectors may generate spurious signals if they exposed to ambient (external) sources of light. This problem becomes aggravated as one attempts to locate such detectors away from the heater elements and closer to the entrance of the cigarette receiving port of the lighter.

OBJECTS AND SUMMARY OF INVENTION

Accordingly, an object of the present invention is to provide a cigarette identifier mechanism in an electrical smoking system which is capable of distinguishing a cavity-bearing cigarette from a more traditional cigarette.

Another object of the present invention is to provide a cigarette identifier system that has the capacity to operate adjacent an electrical heater fixture.

Still another object of the present invention is to provide a cigarette identifier system has the capacity to compensate for the collection of smoke condensates and dirt upon its lens.

Another object of the present invention is to provide a cigarette identifier system that suppresses interference from ambient light.

Still another object of the present invention is to provide a cigarette identifier system which is operable within the compact confines of a hand-held electrical lighter.

These and other objects are achieved with the present invention which provides an electrical smoking system whose lighter includes a cigarette identifier system which is configured to recognize a non-uniformity in the infrared transmissivity of a partially-filled cigarette.

More particularly, the present invention provides a cigarette identifier system and method capable of detecting the presence of the relatively high transmissivity of a cavity within the partially-filled cigarette, wherein a source of infrared light and an infrared detector are provided at a location adjacent the opening of the cigarette receiver.

Another aspect of the present invention is provision for detection of a minimum and maximum infrared readings and provision for a comparison of the detected minimum and maximum readings to a value derived from the threshold value.

Another aspect of the present invention is provision for establishing a threshold signal comprising a running average of detected infrared transmissions so as to suppress the effects of signal perturbations.

Still another aspect of the present invention is provision for the system to enable the lighter to execute puff cycles solely upon a cigarette-insertion detection mode instead of upon a cigarette-identification mode upon recognition within the system that the optical components have become clouded.

BRIEF DESCRIPTION OF THE DRAWING

These and other objects, advantages and novel features of the present invention will become apparent from the following detailed description of the preferred embodiments of the present invention when considered in conjunction with the accompanying drawing, in which.

DETAILED DESCRIPTION OF THE PREFERRED EMBODIMENTS

Figure 1:
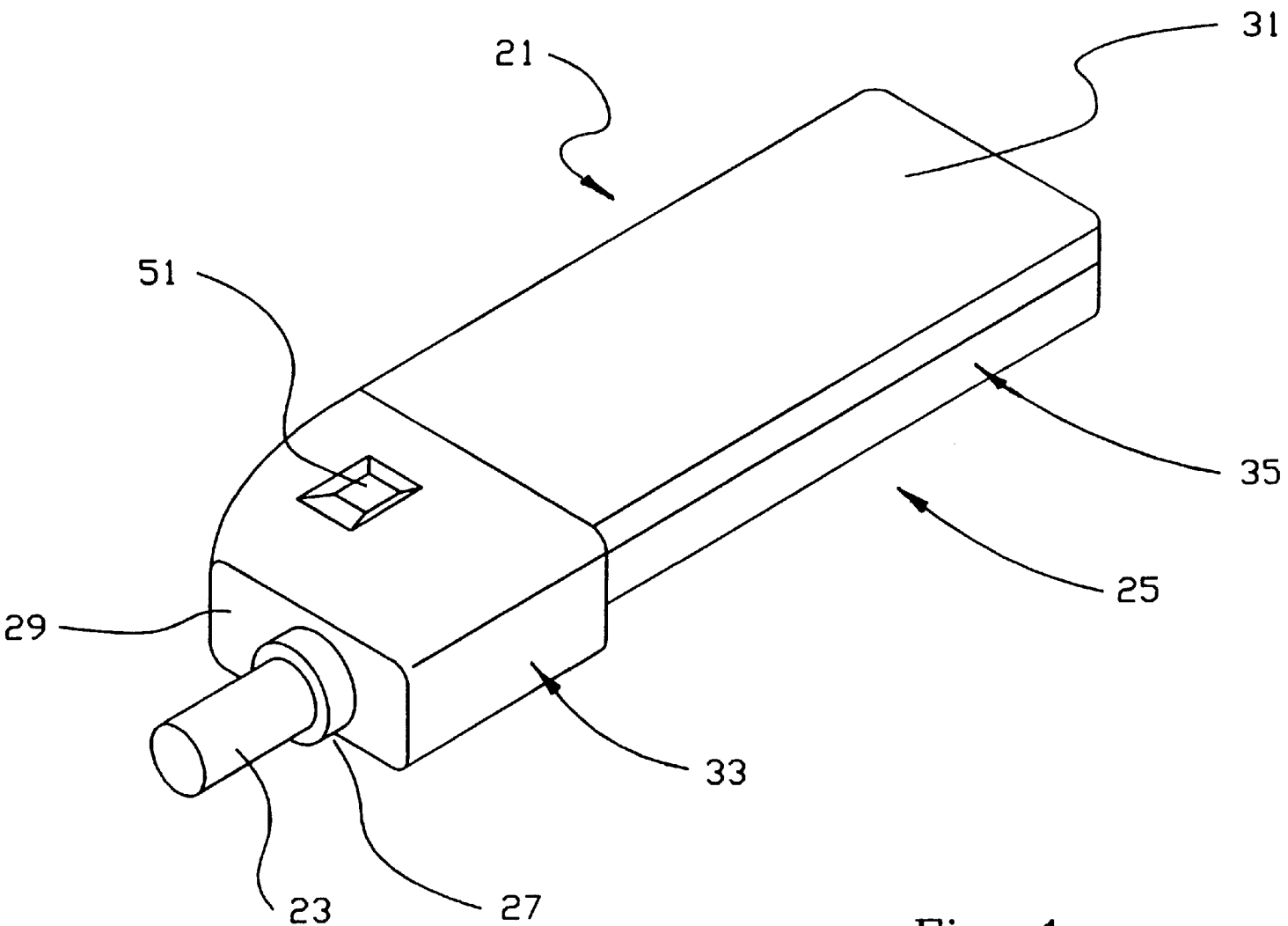
FIG. 1 is a perspective view of a smoking system in accordance with a preferred embodiment of the present invention with a cigarette of the system inserted into the electrically operated lighter.
Figure 2:
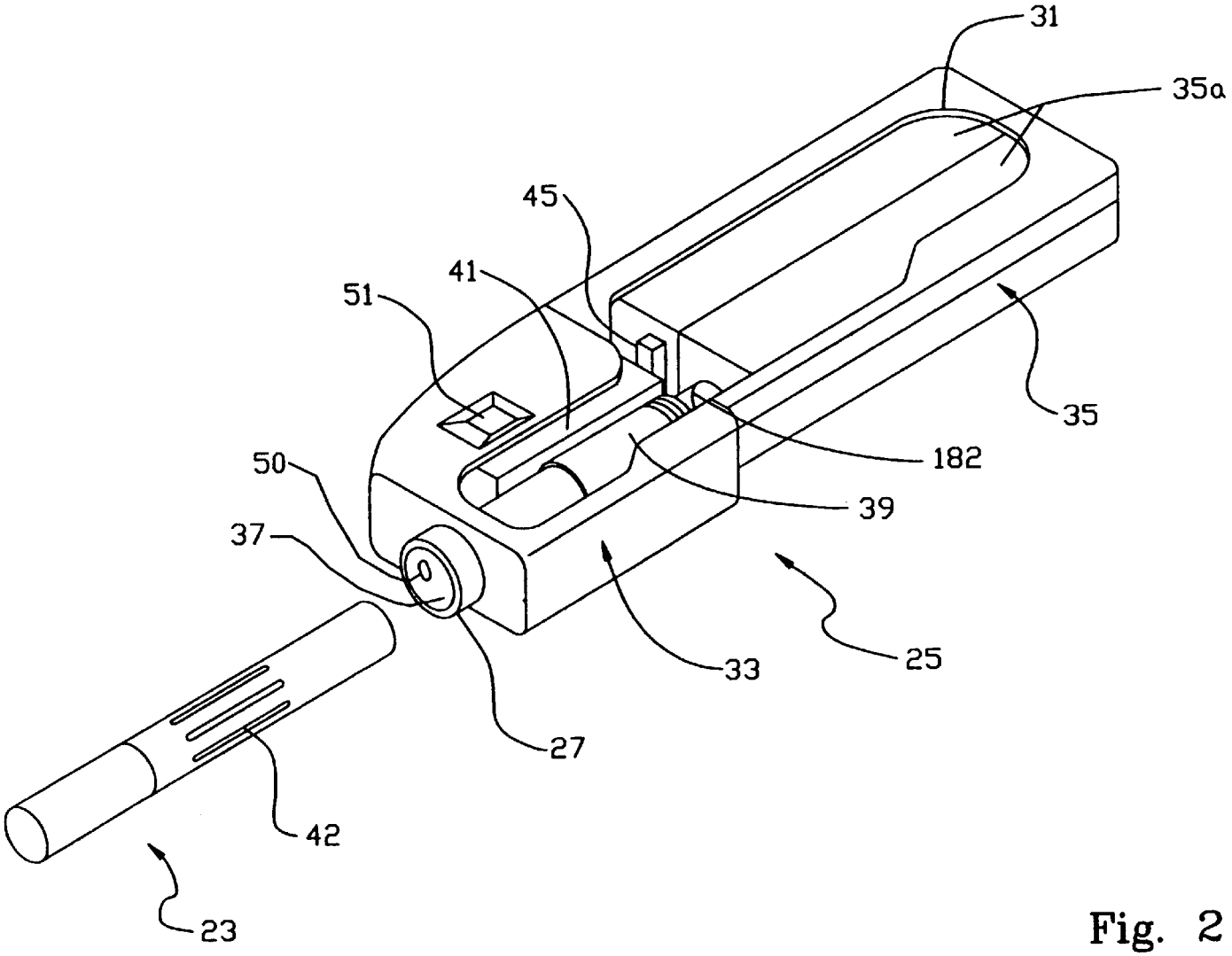
FIG. 2 is a perspective view of the smoking system of FIG. 1, but with the cigarette withdrawn from the lighter upon conclusion of a smoking.

Referring to FIGS. 1 and 2, a preferred embodiment of the present invention provides a smoking system 21 which preferably includes a partially-filled, filter cigarette 23 and a reusable lighter 25. The cigarette 23 is adapted to be inserted into and removed from an annular cigarette receiver 27 which is located at a front end portion 29 of the lighter 25. Once the cigarette 23 has been inserted, the smoking system 21 is used in much the same fashion as a more traditional cigarette, but without lighting or smoldering. The cigarette 23 is discarded after one or more puff cycles. Preferably, each cigarette 23 provides a total of eight puffs (puff cycles) or more per smoke; however it is a matter of design expedient to adjust to a lesser or greater total number of available puffs.

Further particulars of the smoking system is described also in the commonly assigned, U.S. Pat. Nos. 5,388,594; 5,505,214; 5,591,368 and 5,499,636, all which are hereby incorporated by reference in their entireties.

The lighter 25 includes a housing 31 having front and rear housing portions 33 and 35. One or more batteries 35*a* are removably located within the rear housing portion 35 and supply energy to a heater fixture 39 which includes a plurality of electrically resistive, heating elements 37 (shown in FIG. 3). The heating elements 37 are arranged within the front housing portion 33 to slidingly receive the cigarette 23. A stop 182 is provided at a base portion of the heater fixture 39 which assures that full inserted cigarettes 23 are placed consistently relative to the heating elements 37. The cigarette receiver 27, the heating elements 37 and the stop 182 cooperatively establish a cigarette receptacle space 127 for receiving a cigarette 23.

A control circuit 41 in the front housing portion 33 selectively establishes electrical communication between the batteries 35*a* and one or more the heater elements 37 during execution of each puff-actuated power cycle. The preferred embodiment of the present invention includes a cigarette identifier system 50 capable of discerning when a partially-filled filter cigarette 23 is inserted into the lighter 25, aspects which will be detailed in the description which follows.

Still referring to FIGS. 1 and 2, preferably the rear portion 35 of the lighter housing 31 is adapted to be readily opened and closed, such as with screws or snap-fit components, so as to facilitate replacement of the batteries. If desired, an electrical socket or contacts may be provided for recharging the batteries in a charger supplied with house current or the like. Preferably, the front housing portion 33 is removably joined to the rear housing portion 35, such as with a dovetail joint or a socket fit.

The batteries 35*a* are sized to provide sufficient power for the heaters 37 to function as intended and preferably comprise a replaceable and rechargeable type. Alternate sources of power are suitable, such as capacitors. In the preferred embodiment, the power source comprises four nickel-cadmium battery cells connected in series with a total, non-loaded voltage in the range of approximately 4.8 to 5.6 volts. The characteristics of the power source are, however, selected in view of the characteristics of other components in the smoking system 21, particularly the characteristics of the heating elements 37. Commonly assigned U.S. Pat. No. 5,144,962, hereby incorporated by reference, describes several types of power sources useful in connection with the smoking system of the present invention, such as rechargeable battery sources and power arrangements which comprise a battery and a capacitor which is recharged by the battery.

Referring specifically to FIG. 2, preferably, the circuitry 41 is activated by a puff-actuated sensor 45 that is sensitive to either changes in pressure or changes in rate of air flow that occur upon initiation of a draw on the cigarette 23 by a smoker. The puff-actuated sensor 45 is preferably located within the front housing portion 33 of the lighter 25 and is communicated with the cigarette receptacle 127 of the heater fixture 39 via a port extending through a stop 182 located at the base of the heater fixture 39. A puff-actuated sensor 45 suitable for use in the smoking system 21 is described in commonly assigned U.S. Pat. No. 5,060,671 and U.S. Pat. No. 5,388,594, the disclosures of which are incorporated herein by reference.

The puff sensor 45 preferably comprises a Model 163PCO1D35 silicon sensor, manufactured by the MicroSwitch division of Honeywell, Inc., Freeport, Ill. Flow sensing devices, such as those using hot-wire anemometry principles, have also been successfully demonstrated to be useful for actuating an appropriate one of the heater elements 37 upon detection of a change in air flow. Once actuated by the sensor 45, the control circuitry 41 directs electric current to an appropriate one of the heater elements 37.

Figure 3:
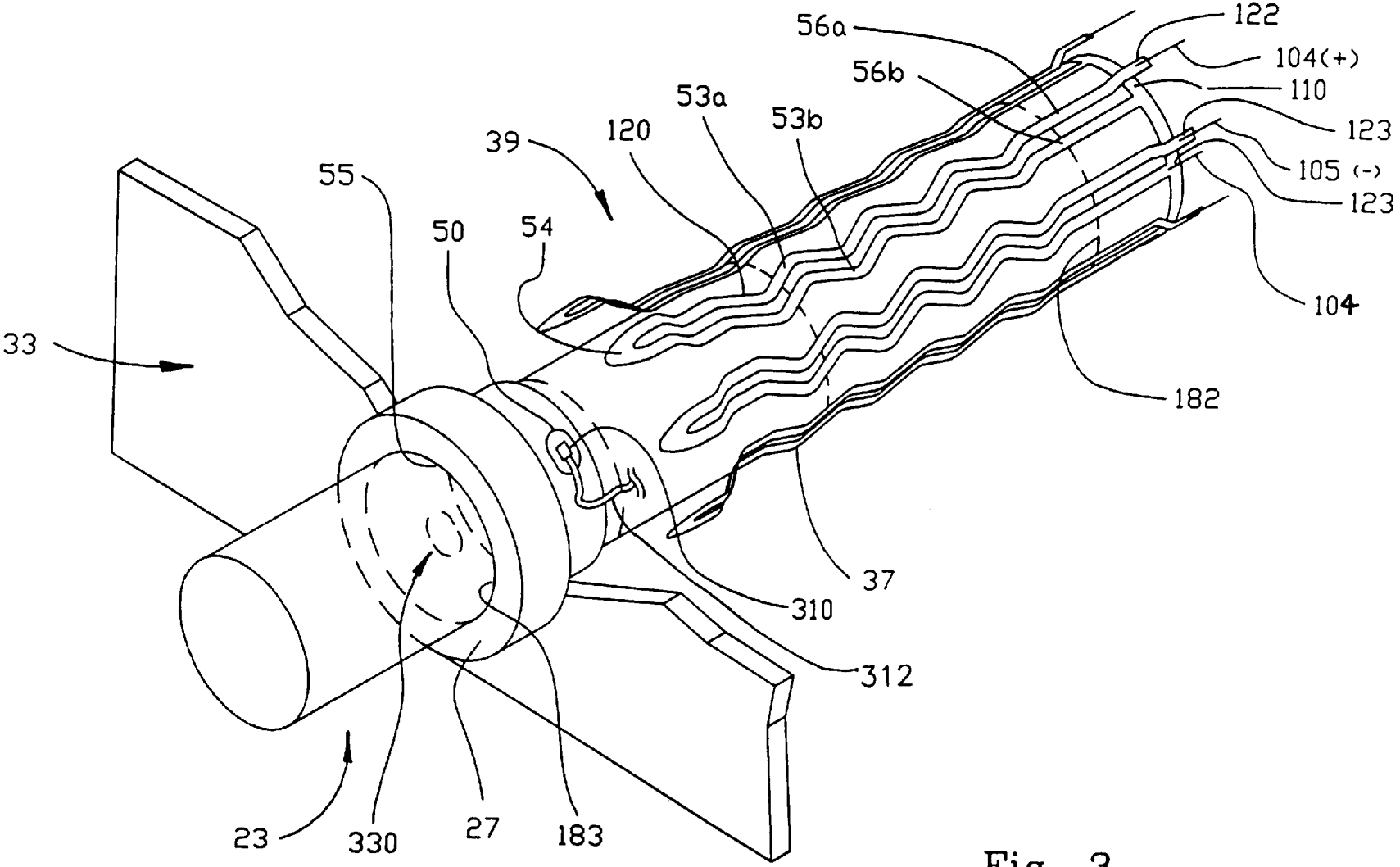
FIG. 3 is a partial, perspective detail view of a preferred embodiment of the heater fixture of FIG. 1, including wavy hairpin heater elements and portions of a preferred cigarette identifier system.

Referring now to FIGS. 3, the cigarette identifier system 50 includes a source of infrared light 310, preferably a light emitting diode ("LED"), and an infrared detector 330, preferably a photo-diode, in opposing relation to the LED emitter source 310 at a location along the cigarette receiver 27. Electrical power and signals are communicated to the LED emitter 310 through a ribbon wire 312 or other suitable electrical connection. Preferably, the infrared source 310 and detector 330 are surface mounted upon optical ports or lens 332 and 328, respectively, which are disposed opposite each other across the opening 183 of the cigarette receiver 27. A preferred infrared source 310 suitable for use with the smoking system 21 is a Model GL 480infrared emitter, manufactured by the Sharp Electronics Corporation of Camas, Wash. A preferred detector 330 is a Model PD 480 PI from the same company. Various other commercially available infrared emitters and detectors may be employed as the source 310 and the detector 330 of the cigarette identifier system 50.

An indicator 51 is provided at a location along the exterior of the lighter 25, preferably on the front housing portion 33, to indicate the number of puffs remaining in a smoke of a cigarette 23. The indicator 51 preferably includes a seven-segment liquid crystal display. In the preferred embodiment, the indicator 51 is caused to display the digit "8" upon cigarette identifier system 50 detecting the presence of a partially-filled cigarette in the heater fixture 39. Preferably, the cigarette identifier system 50 is arranged to provide a signal to the circuitry 41 which, in turn, responsively provides a signal to the indicator 51. The display of the digit "8" on the indicator 51 reflects that the eight puffs provided on each cigarette 23 are available, i.e., no puff cycle has been undertaken and none of the heater elements 37 have been activated to heat the cigarette 23. After the cigarette 23 is fully smoked, the indicator displays the digit "0". When the cigarette 23 is removed from the lighter 25, the cigarette identifier system 50 no longer detects a presence of a cigarette 23 and the indicator 51 is turned off.

In the alternative to displaying the remainder of the puff count, the detector display may instead be arranged to indicate whether the system is active or inactive ("on" or "off").

The cigarette identifier system 50 is modulated so that it does not constantly emit an infrared beam, which would otherwise create an unnecessary drain on the power source 35*a*. Prior to insertion of a cigarette, the system 50 operates in accordance with a watch mode wherein the control circuit 41 drives the LED emitter 310 with pulses of current in the range of approximately 3 to 10 milliamps at a frequency of approximately 16 current pulses per second. Once cigarette insertion has been initially detected, the control logic 195 preferably increases the frequency of the drive current (approximately doubles it) before the system executes an insertion confirmation mode. Upon confirmation that an insertion is occurring, the cigarette identifier system preferably executes a cavity detection mode wherein the control circuit 41 drives the LED emitter 310 at approximately 100 milliamps and at a frequency of approximately 125 current pulses per second. One skilled in the pertinent art would realize that various other current levels and frequencies might be selected instead of the preferred values specifically mentioned in this description of the preferred embodiment of the cigarette identifier system 50.

Power sources, circuitry, puff-actuated sensors, and indicators useful with the smoking system 21 of the present invention are described in commonly assigned, U.S. Pat. Nos. 5,060,671; 5,388,594 and 5,591,368, all which are incorporated herein by reference.

Referring now to FIG. 3, the front housing portion 33 of the lighter 25 encloses a substantially cylindrical heater fixture 39 whose heater elements 37 slidingly receive the cigarette 23. The heater fixture 39 is adapted to support an inserted cigarette 23 in a fixed relation to the heater elements 37 such that the heater elements 37 are positioned alongside the cigarette 23 at approximately the same location along each newly inserted cigarette 23. In the preferred embodiment, the heater fixture 39 includes eight mutually parallel heater elements 37 which are disposed concentrically about the axis of symmetry of the cigarette receiver 27. The locations where each heater element 37 bears against (or is in thermal communication with) a fully inserted cigarette 23 is referred to herein as the heater footprint.

Still referring to FIG. 3, most preferably the heater elements 37 are of a design referred to herein as a wavy hairpin heater element 37, wherein each heater element 37 includes at least first and second serpentine, elongate members 53*a* and 53*b* which are adjoined at an end portion (tip) 54. The tips 54 are adjacent the opening 183 of the cigarette receiver 27. The opposite ends 56*a* and 56*b* of each heater element 37 are electrically connected to the opposite poles of the power source 35*a* as selectively established by the controller 41. More specifically, an electrical pathway through each heater fixture 37 is established, respectively, through a terminal pin 104, a connection 122 between the pin 104 and a free end portion 56*a* of one of the serpentine members 53*a*, through at least a portion of the tip 54 to the other serpentine member 53*b* and its end portion 56*b*. Preferably, an integrally formed, common connection ring 110 provides a common electrical connection amongst all the end portions 56*b* of the elongate member 53*b*. In the preferred embodiment, the ring 110 is connected to the positive terminal of the power source 35*a* (or common) through a connection 123 between the ring 110 and a pin 105. Further details of the construction and establishment of electrical connections in the heater fixture 39 are illustrated and described in the commonly assigned U.S. Pat. Nos. 5,060,671; 5,388,594 and 5,591,368, all which are incorporated herein by reference.

Additional heater fixtures 37 that are operable as part of the lighter 25 include those disclosed in commonly assigned, U. S. Pat. No. 5,665,262; and commonly assigned, U.S. Pat. No. 5,498,855, all which applications are incorporated herein by reference in their entireties.

Preferably, the heaters 37 are individually energized by the power source 35*a* under the puff-actuated control of the circuitry 41 to heat the cigarette 23 preferably eight times at spaced locations about the periphery of the cigarette 23. The heating renders eight puffs from the cigarette 23, as is commonly achieved with the smoking of a more traditional cigarette. It may be preferred to activate more than one heater simultaneously for one or more or all of the puffs.

Figure 4:
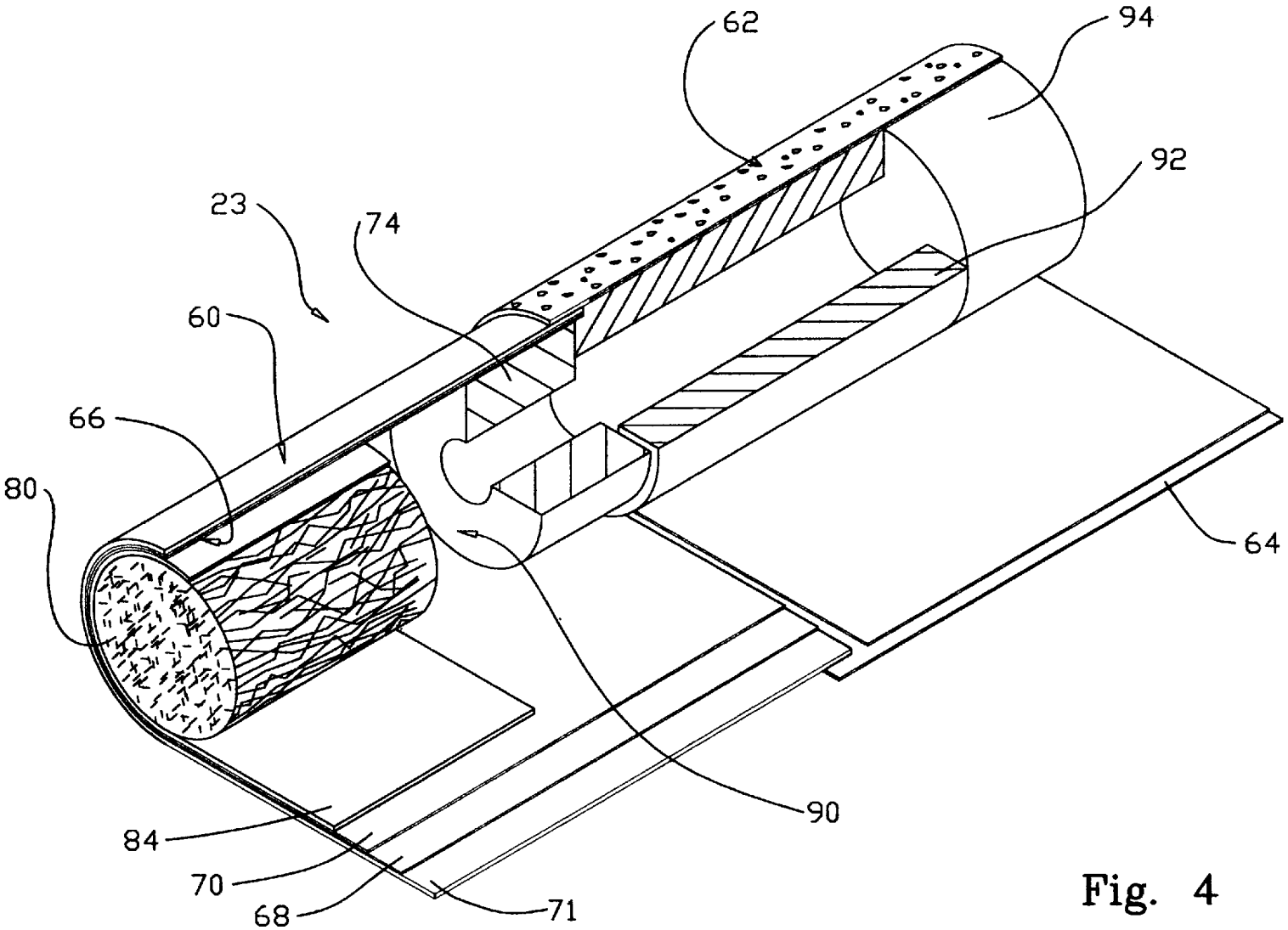
FIG. 4 is a detail perspective view of a preferred embodiment of the partially-filled cigarette shown in FIG. 1, with certain components of the cigarette being partially unraveled.

Referring now to FIG. 4, the cigarette 23 is preferably constructed in accordance with the preferred embodiment set forth in commonly assigned, U.S. Pat No. 5,499,636, herein incorporated by reference in its entirety.

The cigarette 23 comprises a tobacco rod 60 and a filter tipping 62, which are joined together with tipping paper 64.

The tobacco rod 60 of the cigarette 23 preferably includes a tobacco web 66 which has been folded into a tubular (cylindrical) form about a free-flow filter 74 at one of its ends and a tobacco plug 80 at the other. In the alternative, a plug of cellulose acetate might be used in place of the tobacco plug 80.

An overwrap 71 is intimately wrapped about the tobacco web 66 and is held together along a longitudinal seam as is common in construction of more traditional cigarettes. The overwrap 71 retains the tobacco web 66 in a wrapped condition about a free-flow filter 74 and a tobacco plug 80.

The tobacco web 66 itself preferably comprises a base web 68 and a layer of tobacco flavor material 70 located along the inside surface of the base web 68. At the tipped end 72 of the tobacco rod 60, the tobacco web 66 together with the overwrap 71 are wrapped about the tubular free-flow filter plug 74. Preferably, the tobacco plug 80 is constructed separately from the tobacco web 66 and comprises a relatively short column of cut filler tobacco that preferably has been wrapped within and retained by a plug wrap 84.

As a general matter, the length of the tobacco plug 80 is preferably set relative to the total length of the tobacco rod 60 such that a void (or "cavity") 90 is established along the tobacco rod 60 between the free-flow filter 74 and the tobacco plug 80. The void 90 corresponds to an unfilled portion of the tobacco rod 60 and is in immediate fluid communication with the tipping 62 through the free flow filter 74 of the tobacco rod 60.

The tipping 62 preferably comprises a free-flow filter 92 located adjacent the tobacco rod 60 and a mouthpiece filter plug 94 at the distal end of the tipping 62 from the tobacco rod 60. Preferably, the free-flow filter 92 is tubular and transmits air with very little pressure drop. Other low efficiency filters of standard configuration could be used instead, however. The inside diameter for the free flow filter 92 is preferably at or between 2 to 6 millimeters and is preferably greater than that of the free flow filter 74 of the tobacco rod 60.

The mouthpiece filter plug 104 closes off the free end of the tipping 62 for purposes of appearance and, if desired, to effect some filtration, although it is preferred that the mouthpiece filter plug 104 comprise a low efficiency filter of preferably about 15 to 25 percent efficiency.

Figure 5:
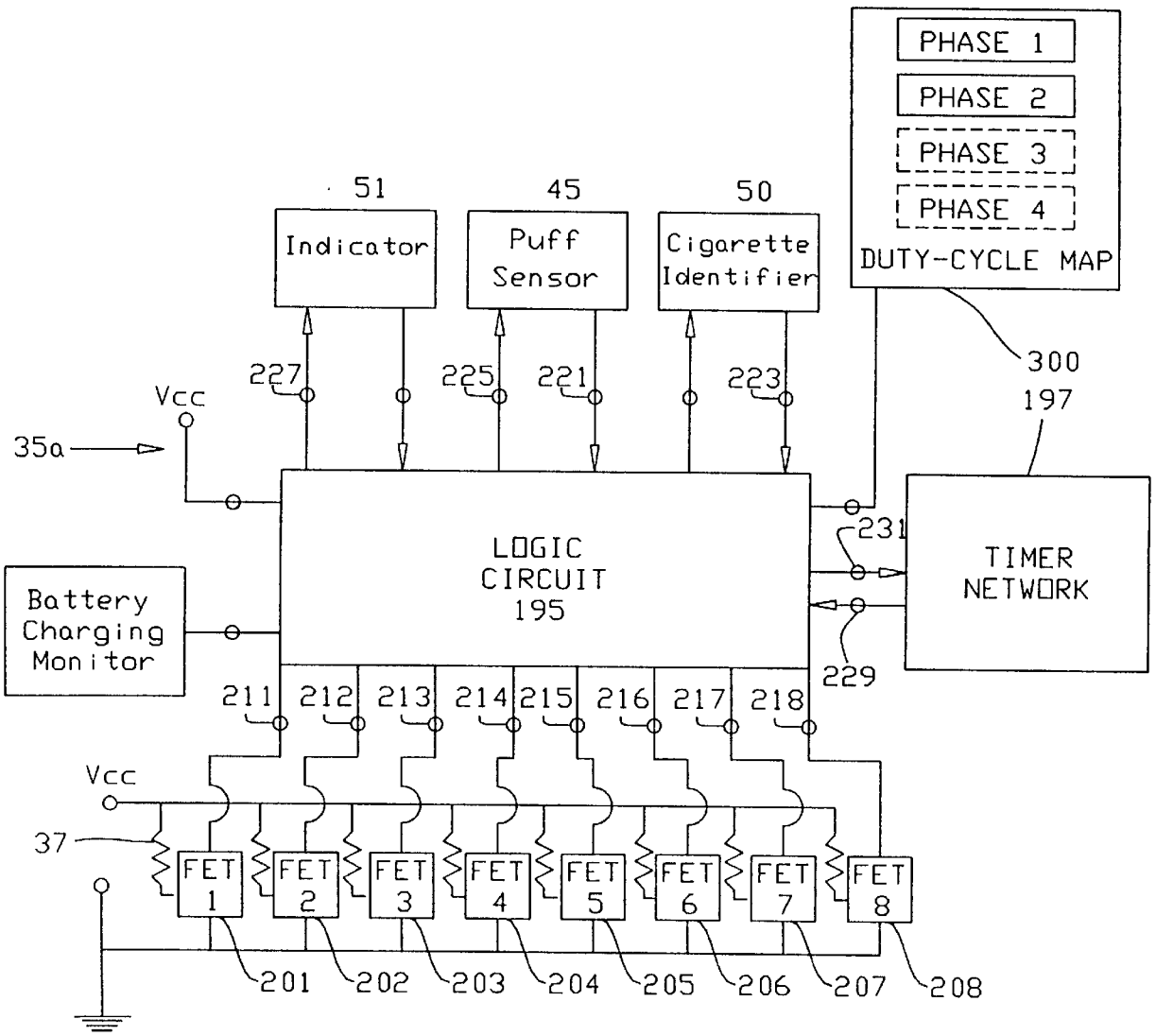
FIG. 5 is a schematic, block-diagram of a preferred control circuit of the lighter shown in FIGS. 1 and 2.

Referring now to FIGS. 2 and 5, the electrical control circuitry 41 of the lighter 25 includes a logic circuit 195, which preferably comprises a micro-controller or an application specific, integrated circuit (or "ASIC"). The control circuitry also includes the cigarette identifier system 50 for detecting the insertion of a cigarette into the cigarette receptacle 127 of the lighter 25 and discerning whether it is a partially-filled cigarette 23, the puff sensor 45 for detecting a draw upon the inserted cigarette 23, the LCD indicator 51 for indicating the number of puffs remaining on a cigarette, the power source 37 and a timing network 197.

The logic circuit 195 may comprise any conventional circuit capable of implementing the functions discussed herein. A field-programmable gate array (e.g., a type ACTEL A1280A FPGA PQFP 160, available from Actel Corporation, Sunnyvale, Calif.) or a micro controller can be programmed to perform the digital logic functions with analog functions performed by other components. An ASIC or micro-controller can perform both the analog and digital functions in one component. Features of control circuitry and logic circuitry similar to the control circuit 41 and logic circuit 195 of the present invention are disclosed, for example, in commonly assigned, U.S. Pat. Nos. 5,388,594; 5,505,214; 5,591,368; and 5,499,636, all which are hereby incorporated by reference in their entireties. Further details are also provided in the copending, commonly assigned U.S. application Ser. No. 08/755,044 filed Oct. 22, 1996, which is hereby incorporated by reference in its entirety.

In the preferred embodiment, eight individual heater elements 37 are connected to a positive terminal of the power source 35*a* and to ground through corresponding field effect transistor (FET) heater switches 201–208. Individual (or selected) ones of the heater switches 201–208 will turn on under control of the logic circuit 195 through terminals 211–218, respectively, during execution of a power cycle by the logic circuit 195. The logic circuit 195 provides signals for activating and deactivating particular ones of the heater switches 201–208 to activate and deactivate the corresponding heater element 37 of the heater fixture 39.

The logic circuit 195 cooperates with the timing circuit 197 to precisely execute the activation and deactivation of each heater element 37 in accordance with a predetermined total cycle period ("total") and to precisely divide each total cycle period into a predetermined number of phases, with each phase having its own predetermined period of time ("$t_{phase}$"). In the preferred embodiment, the total cycle period total has been selected to be 1.6 seconds (so as to be less than the two-second duration normally associated with a smoker's draw upon a cigarette, plus provision for margin) and the total cycle period total is divided preferably into two phases, a first phase having a predetermined time period ("$t_{phase}1$") of 1.0 seconds and a second phase having a predetermined time period ("$t_{phase}2$") of 0.6 seconds. The total cycle period total, the total number of phases and the respective phase periods are parameters, among others, that are resolved in accordance with the teachings which follow for establishing within the control circuit 41, a capacity to execute a power cycle that precisely duplicates a preferred thermal interaction ("thermal profile" or "thermo-histogram") between the respective heater element 37 and adjacent portions of the cigarette 23. Additionally, once the preferred thermo-histogram is established, certain parameters (preferably, duty cycles within each phase) are adjusted dynamically by the control circuit 41 so as to precisely duplicate the predetermined thermo-histogram with every power cycle throughout the range of voltages $v_{in}$ encompassed by the aforementioned battery discharge cycle.

The puff-actuated sensor 45 supplies a signal to the logic circuit 195 that is indicative of smoker activation (i.e., a continuous drop in pressure or air flow over a sufficiently sustained period of time). The logic circuit 195 includes a debouncing routine for distinguishing between minor air pressure variations and more sustained draws on the cigarette to avoid inadvertent activation of heater elements in response to errant signal from the puff-actuated sensor 45. The puff-actuated sensor 45 may include a piezoresistive pressure sensor or an optical flap sensor that is used to drive an operational amplifier, the output of which is in turn used to supply a logic signal to the logic circuit 195. Puff-actuated sensors suitable for use in connection with the smoking system include a Model 163PC01D35 silicon sensor, manufactured by the MicroSwitch division of Honeywell, Inc., Freeport, Ill., or a type NPH-5-02.5G NOVA sensor, available from Lucas-Nova, Freemont, Calif., or a type SLP004D sensor, available from SenSym Incorporated, Sunnyvale, Calif.

In order to conserve energy, it is preferred that the puff-actuated sensor 45 be cycled on and off at low duty cycles (e.g., from about a 2 to 10% duty cycle). For example, it is preferred that the puff actuated sensor 45 be turned on for a 1 millisecond duration every 10 milliseconds. If, for example, the puff actuated sensor 45 detects pressure drop or air flow indicative of a draw on a cigarette during four consecutive pulses (i.e., over a 40 millisecond period), the puff actuated sensor sends a signal through a terminal 221 to the logic circuit 195. The logic circuit 195 then sends a signal through an appropriate one of the terminals 211–218 to turn an appropriate one of the FET heater switches 201–208 ON.

Similarly, the cigarette identifier 50 is preferably turned on in a watch mode wherein the LED emitter 310 is operated at 16 hertz at approximately 3–10 milliamps so to conserve power as previously explained. Output of the cigarette identifier system 50 is directed through a terminal 223 to the logic circuit 195. Upon receipt of a signal from the cigarette identifier system 50 indicating that a partially filled cigarette has been inserted into the cigarette receptacle 127, the logic circuit 195 sends a signal through terminal 225 to the puff-actuated sensor 45 to turn on the puff-actuated sensor so that puff-actuated power cycles may commence. The logic circuit 195 also sends a signal through terminal 227 to the indicator 51 to turn it on.

The logic circuit 195 includes a PROM (programmable read-only memory) 300, which includes preferably at least two data bases or "look-up tables" 302 and 304, and optionally, a third data base (look-up table) 306 and possibly a fourth look-up table 307 or more. Each of the look-up tables 302, 304 (and optionally 306, 307) converts a signal indicative of battery voltage $v_{in}$ to a signal indicative of the duty cycle ("$dc_1$" for the first phase and "$dc_2$" for the second phase) to be used in execution of the respective phase of the immediate power cycle. Third and fourth look-up tables 306 and 307 function similarly.

Upon initiation of a power cycle, the logic circuit receives a signal indicative of battery voltage $v_{in}$, and then references the immediate reading $v_{in}$ to the first look-up table 302 to establish a duty cycle $dc_1$ for the initiation of the first phase of the power cycle. The first phase is continued until the timing network 197 provides a signal indicating that the predetermined time period of the first phase $t_{phase\ 1}$ has elapsed, whereupon the logic circuit 195 references $v_{in}$ and the second look-up table 304 and establishes a duty cycle $dc_2$ for the initiation the second phase. The second phase is continued until the timing network 197 provides a signal indicating that the predetermined time period of the second phase $t_{phase\ 2}$ has elapsed, whereupon the timing network 197 provides a shut-off signal to the logic circuit 195 at the terminal 229. Optionally, the logic circuit 195 could initiate a third phase and establish a third duty cycle $dc_3$, and the shut-off signal would not be generated until the predetermined period of the third phase ($t_{phase\ 3}$) had elapsed. A similar regimen could optionally be established with a fourth phase ($t_{phase\ 4}$). The present invention could be practiced with additional phases as well.

Although the present invention can be practiced by limiting reference to the look-up tables to an initial portion of each phase to establish a duty cycle to be applied throughout the substantial entirety of each phase, a refinement and the preferred practice is to have the logic circuit 195 configured to continuously reference $v_{in}$ together with the respective look-up tables 302, 303, 306 and 307 so as to dynamically adjust the values set for duty cycles in response to fluctuations in battery voltage as the control circuit progresses through each phase. Such device provides a more precise repetition of the desired thermo-histogram.

Other timing network circuit configurations and logic circuits may also be used, such as those described in the commonly assigned, U.S. Pat. Nos. 5,388,594; 5,505,214; 5,591,368; 5,499,636; and 5,372,148, all which are hereby incorporated by reference in their entireties.

During operation, a cigarette 23 is inserted in the lighter 25 and the presence of the cigarette is detected by the cigarette sensor 57. The cigarette sensor 57 sends a signal to the logic circuit 195 through terminal 223. The logic circuit 195 ascertains whether the power source **35*a* is charged or whether the immediate voltage is below an acceptable minimum $v_{in\ min}$. If, after insertion of a cigarette 23 in the lighter 25, the logic circuit 195 detects that the voltage of the power source 35*a* is too low, below $v_{in\ min}$, the indicator 51 blinks and further operation of the lighter will be blocked until the power source 35*a* is recharged or replaced. Voltage of the power source 35*a* is also monitored during firing of the heater elements 37 and the firing of the heater elements 37** is interrupted if the voltage drops below a predetermined value.

If the power source **35*a* is charged and voltage is sufficient, the logic circuit 195 sends a signal through terminal 225 to the puff sensor 45 to determine whether a smoker is drawing on the cigarette 23. At the same time, the logic circuit 195 sends a signal through the terminal 227 to the indicator 51** so that the LCD will display the digit "8", reflecting that eight puffs are available.

When the logic circuit 195 receives a signal through terminal 221 from the puff-actuated sensor 45 that a sustained pressure drop or air flow has been detected, the logic circuit 195 sends a signal through terminal 231 to the timer network 197 to activate the timer network, which then begins to function phase by phase in the manner previously described. The logic circuit 195 also determines, by a downcount routine, which one of the eight heater elements is due to be heated and sends a signal through an appropriate terminal 211–218 to turn an appropriate one of the FET heater switches 201–208 ON. The appropriate heater stays on while the timer runs.

When the timing network 197 sends a signal through terminal 229 to the logic circuit 195 indicating that the timer has stopped running, the particular ON FET heater switch 211–218 is turned OFF, thereby removing power from the particular heater element 37. The logic circuit 195 also downcounts and sends a signal to the indicator 51 through terminal 227 so that the indicator will display that one less puff is remaining (e,g., "7", after the first puff). When the smoker next puffs on the cigarette 23, the logic circuit 195 will turn ON another predetermined one of the FET heater switches 211–218, thereby supplying power to another predetermined one of the heater elements. The process will be repeated until the indicator 51 displays "0", meaning that there are no more puffs remaining on the cigarette 23. When the cigarette 23 is removed from the lighter 25, the cigarette sensor 57 indicates that a cigarette is not present, and the logic circuit 195 is reset.

Other features, such as those described in U.S. Pat. No. 5,505,214; 5,388,594; and 5,372,148 which are incorporated by reference, may be incorporated in the control circuitry 41 instead of or in addition to the features described above. For example, if desired, various disabling features may be provided. One type of disabling feature includes timing circuitry (not shown) to prevent successive puffs from occurring too close together, so that the power source **35*a*** has time to recover.

Figure 6A:
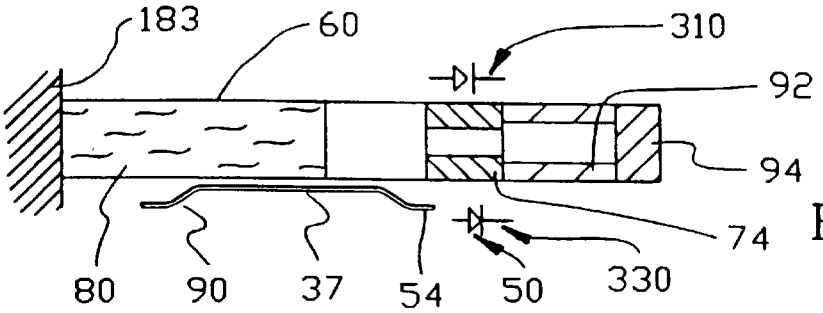
FIG. 6A is a sectional side view of the partially-filled cigarette shown in FIG. 4 in relation to components of the heater fixture shown in FIG. 3.

Generally, the partially-filled cigarette 23 includes a structure, when viewed as moving from left to right in FIG. 6A, of a first high density region defined by the tobacco plug 80 followed by a region of lowest density defined by the cavity 90, which in turn is followed by a region of intermediate density comprising the first and second free-flow filters 74 and 92 and the mouth piece filter 94.

Figure 6B:
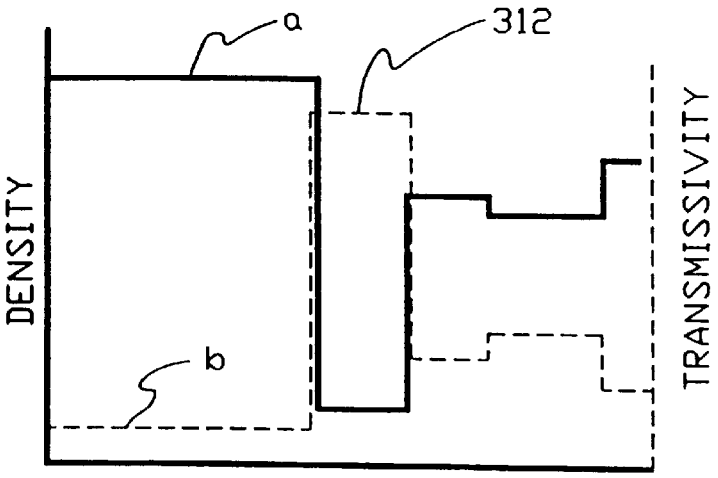
FIG. 6B is a graphical representation of the density and infrared transmissivity characteristics along the partially-filled cigarette shown in FIG. 6.

Referring particularly to FIG. 6B, the line a is indicative of the relative magnitude of density as one progresses in like fashion along the cigarette 23 from left to right as described above in reference to FIGS. 6A. The line b in FIG. 6B is indicative of the relative magnitude of infrared transmissivity as one progresses in like fashion along the cigarette 23 from left to right as described above in reference to FIGS. 6A. Because infrared transmissivity is inversely proportional to density at the locus of transmission, line b (transmissivity) in FIG. 6B peaks where density troughs in the region designated 312, which corresponds with the cigarette cavity 90 in FIG. 6A. Accordingly, infrared transmissivity provides a signature which is useable to distinguish the partially-filled cigarette 23 from other cigarette designs.

Figure 6C:
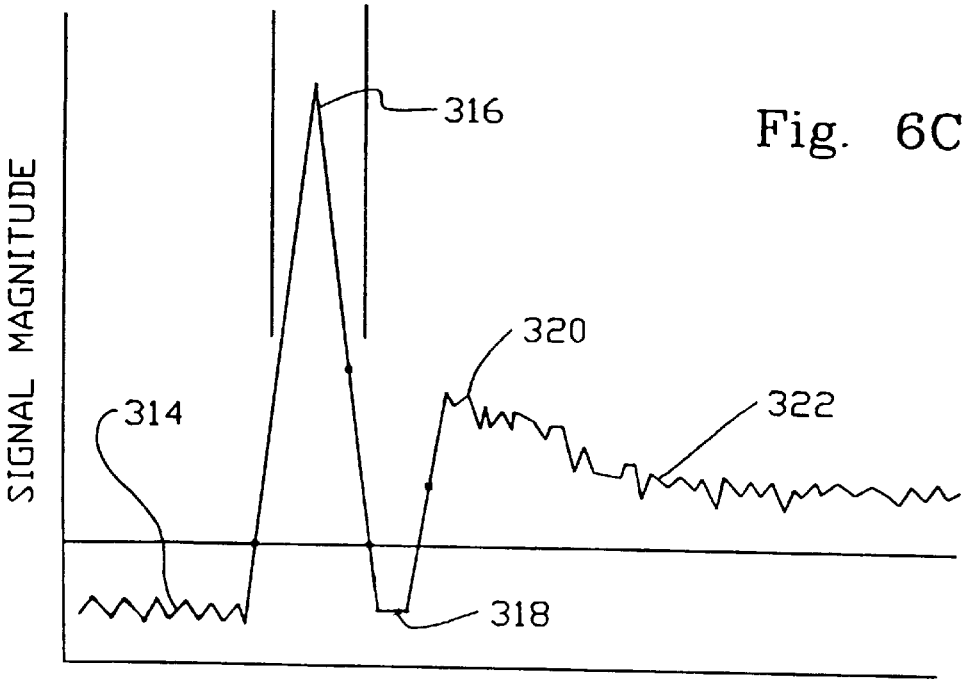
FIG. 6C is a graphical representation of transmissivity measurements achieved upon moving a partially-filled cigarette from right to left as shown in FIG. 4 across an infrared detector.

A partially-filled cigarette 23 of structure described in reference to FIG. 6A was passed by a source of infrared light and a detector, and the magnitude of voltage output of the detector was recorded as line c in FIG. 6C. The general course of line c initiates with a first lowest-most region 314 of detected infrared transmission, which region corresponds with the most dense portion of the cigarette 23, the tobacco plug 80. This characteristic (the lowest transmissivity) is utilized to detect initiation of a cigarette being inserted into the lighter 25. Transmissivity then spikes and provides a peak signal 316 corresponding to the least dense portion of the cigarette 23, the cavity 90. Thereafter transmissivity drops again at region designated 318 along line c of the graphical representation, which region corresponding with the first free-flow filter 74 of the cigarette 23. A second, lower signal peak occurs at designation 320 corresponding with the less dense region of the second free-flow filter 92. The next region 322 of the signal is indicative of the intermediate density of the mouth piece filter 94.

Accordingly, passage of the cigarette 23 past an infrared detector provides an infrared transmissivity signal providing at least one peak signal 316 of sufficient magnitude to utilize for product identification during the operation of the lighter 25.

When a partially-filled cigarette 23 is inserted into the lighter 25, it is registered against the stop 183, with the source 310 and the infrared sensor 330 of the cigarette identifier system 50 located at or about the location of the free-flow filter 74 of the tobacco rod 60. This relation is shown in FIG. 6A, together with the overlapping relationship of the heater elements 37 over the filled and unfilled portions 80, 90 of the cigarette 23.

Figure 7:
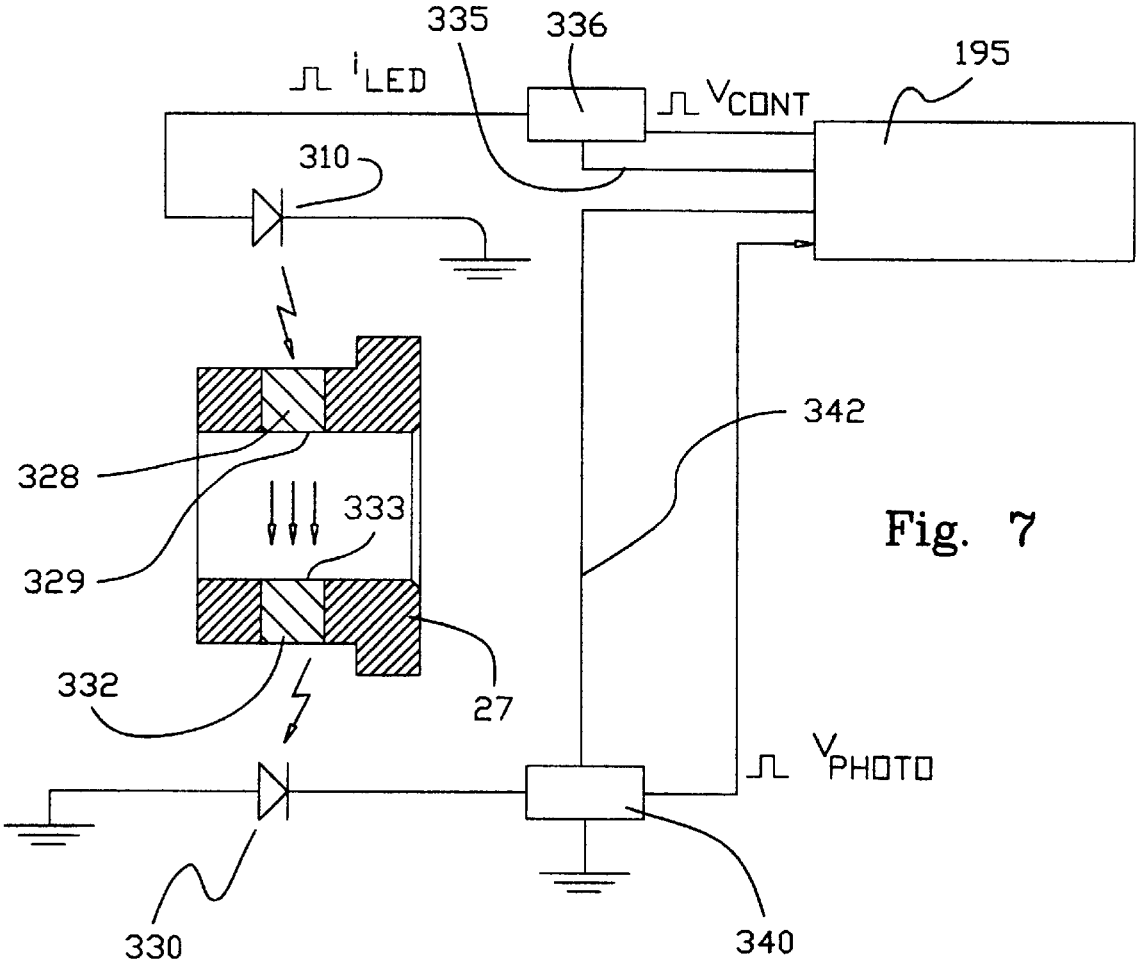
FIG. 7 is a schematic showing a layout of the cigarette identifier system constructed in accordance with a preferred embodiment of the present invention.

Referring now to FIG. 7, a preferred layout for the cigarette identifier system 50 includes placement of an LED diode emitter 310 disposed adjacent (preferably surface mounted upon) the infrared transmissive lens 328 in the annular cigarette receiver 27 of the lighter 25. Likewise, opposite of the first lens 328, a second infrared transmissive lens 332 is provided in the cigarette annular cigarette receiver 27. A photo-diode 330 is located adjacent (preferably surface mounted upon) the second lens 332. The lens 328, 332 not only isolate the LED emitter 310 and the photo-diode 330 from the confines of the cigarette receptacle 127, but also help attenuate energy transfers from the heater elements 37 to the LED emitter 310 and the photo-diode 330.

Preferably, power to the LED emitter 310 is controlled by a drive output of the logic circuit 195 comprising voltage pulses ($v_{cont}$) in the range of 0 to 5 volts. Preferably, the cigarette identifier system 50 includes a current amplifier 336 which converts the voltage pulses from the logic circuit 195 into current pulses ($i_{LED}$) of a magnitude proportional to the magnitude of voltage pulses ($v_{cont}$). Preferably, the current amplifier 336 is switchable between low and high gain operational settings upon receipt of a signal from the logic circuit 195 through a control line 338.

The current amplifier 336 of the preferred embodiment is a Toshiba Model TC 75 W51F V (the U version is also preferred). Other amplifiers offering comparable functionalities and capabilities might be used instead.

The current amplifier 336 is set at low gain while the cigarette identifier system 50 is in a watch mode so as to preserve electrical power and to facilitate adjustments of power to the LED emitter 310 during normalization of signals during the watch mode. The watch mode is continued as long as a cigarette remains absent from the cigarette receptacle 127 of the lighter 25. In the watch mode, the LED emitter 310 is preferably operated at a drive current $i_{LED}$ in the range of approximately 3 to 10 milliamperes and at a frequency of approximately 16 pulses per second. At all other times, the current amplifier 336 is operated at the high gain setting, including a cavity detection mode, wherein the LED emitter 310 is preferably operated at a drive current $i_{LED}$ in the range of 100 milliamperes and a frequency of approximately 125 pulses per second. The higher gain of the current amplifier 336 is set so as to meet the operational requirements of the more highly powered cavity detection mode.

The output of the photo-diode 330 is directed to a photo-amplifier 340 whose output $v_{photo}$ is communicated to the logic circuit 195 through an electrical connection 342. At an interface with the logic circuit 195, the output of the photo-amplifier 340 is converted from an analog signal to a digital signal. The Toshiba Model TC 75 W51F V (the U version is also preferred) serves as the photo-amplifier 340 of the preferred embodiment. Other amplifiers offering comparable functionalities and capabilities might be used instead.

Preferably, the photo-amplifier 340 is configured to provide a frequency response such that the gain applied to a rapidly changing signal (e.g., a pulsating signal) is much greater than the gain applied to a constant (or near constant) input signal. Preferably, the gain for the high frequency response is set at a level approximately 50 to 200 times the gain provided to the low frequency response and more preferably approximately 150 to 200 times the latter.

Accordingly, the photo-amplifier 340 is selectively responsive to high frequency signals and provides little gain for low frequency signals that are received from the photo-diode 330. Ambient light tends to cause the photo-diode 330 to generate nearly constant or low frequency signals, and accordingly, the photo-amplifier 340 is relatively non-responsive to signals resulting from ambient sources and is much more responsive to high frequency variations such as result from the pulsed emissions of the LED emitter 310.

Because an inserted cigarette will block ambient light, once the control logic 195 determines that a cigarette has been inserted into the lighter 25, it may optionally be programmed to switch the photo-amplifier 340 to a second mode wherein its frequency response is more uniform.

Each reading during the watch cycle and other modes is referred to as a signal $S_i$ which equals $R_1$ minus $R_2$, where $R_1$ is a reading of the output of the photo-amplifier 340 just prior to initiation of a drive pulse ($v_{cont}$) from the logic circuit 195 and $R_2$ is a reading of the output of the photo-amplifier 340 during execution of the drive pulse ($v_{cont}$). Accordingly, the portion of photo-amplifier signal that is attributable to the surrounding environment is, in effect, subtracted-out of the reading $S_i$.

Steps are undertaken during the watch mode by the control logic 195 to normalize the reading $S_i$ from the photo-amplifier 340.

First of all, during the aforementioned watch mode, the LED emitter 310 is operated as previously described (3 to 10 milliamps at 16 cycles per second) and from the output of the photo-amplifier, the logic control 195 establishes a weighted, running average, signal count $S^{TH}_i$ in accordance with the following relationship:

$$S^{TH}_i=(15/16)\cdot S^{TH}_{i-1}+(1/16)\cdot S_i,$$

wherein $S^{TH}_{i-1}$ is the count existing at conclusion of the previous pulse of the LED emitter 310.

In the normalization process, the control circuit 195 compares the current value of the signal count ($S^{TH}_i$) to a nominal value such as the digital value 75 amongst a typical digital range of 0 to 255. If the control circuit 195 detects a difference between the immediate signal count $S^{TH}_i$ and the nominal value, the logic circuit 195 will adjust the amplitude of its drive output ($v_{cont}$) such that the LED emitter 310 emits an adjusted output such that the photo-amplifier output is driven closer to the nominal value.

Accordingly, a threshold baseline signal $S^{TH}_i$ is established that has a nominal amplitude (preferably, a digital approximately 75 in the range of 0 to 255). This aspect is important, because the first signal change resulting from the insertion of a cigarette 23 is a drop in signal due to the tobacco rod portion of the cigarette 23 being interposed between the transmitter 310 the detector 330. If the threshold were allowed to reduce excessively, the drop in signal value associated with the cigarette would become difficult to detect. Additionally, the normalization also helps the system compensate for loss of transmission through the windows 328 and 332 as dirt and smoke condensates begin to accumulate on the inside surfaces 329 and 333 thereof.

However, if the dirt or other accumulations clouding the lens 329 and 332 are excessive, an excessive amount of drive power ($i_{LED}$) will be required to generate a normalized signal count $S^{TH}_i$. Such can create an unacceptable demand on the batteries 35 in maintaining the watch mode. Also, such condition (excessive drive current $i_{LED}$) is indicative that the cigarette identifier system 50 is too optically dirty for readily detecting certain changes in signal output to function reliably.

Accordingly, the control circuit 195 is programmed to check, after normalization, as to whether the system 50 had to elevate the drive current $i_{LED}$ to unacceptably high levels. In the preferred embodiment, the control logic checks whether $i_{LED}$ is above 70% of the maximum value obtainable for $i_{LED}$ during the watch mode (when the current amplifier 336 is at low gain). If so, it locks out any further execution of the peak signal test and allows the lighter 25 to enter puff-actuated operation merely upon cigarette insertion detection and confirmation of same, as will be detailed further in the discussions which follow.

LOGIC MODES OF THE PREFERRED CIGARETTE IDENTIFIER SYSTEM

Figure 8A:
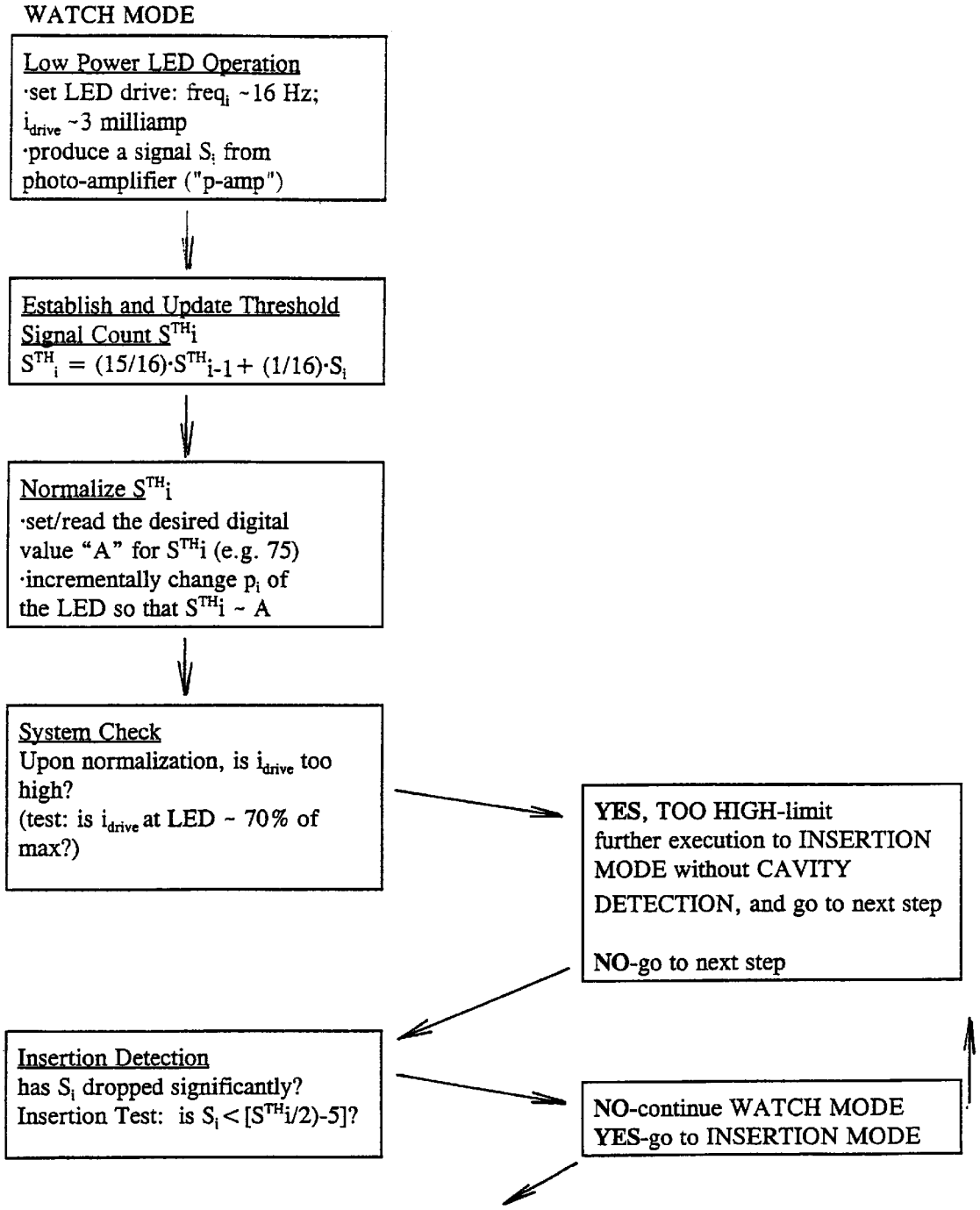
FIGS. 8A–C set forth a flow chart of logic routines executable by the logic circuitry in cooperation with the cigarette identifier system shown in FIG. 7.
Figure 8B:
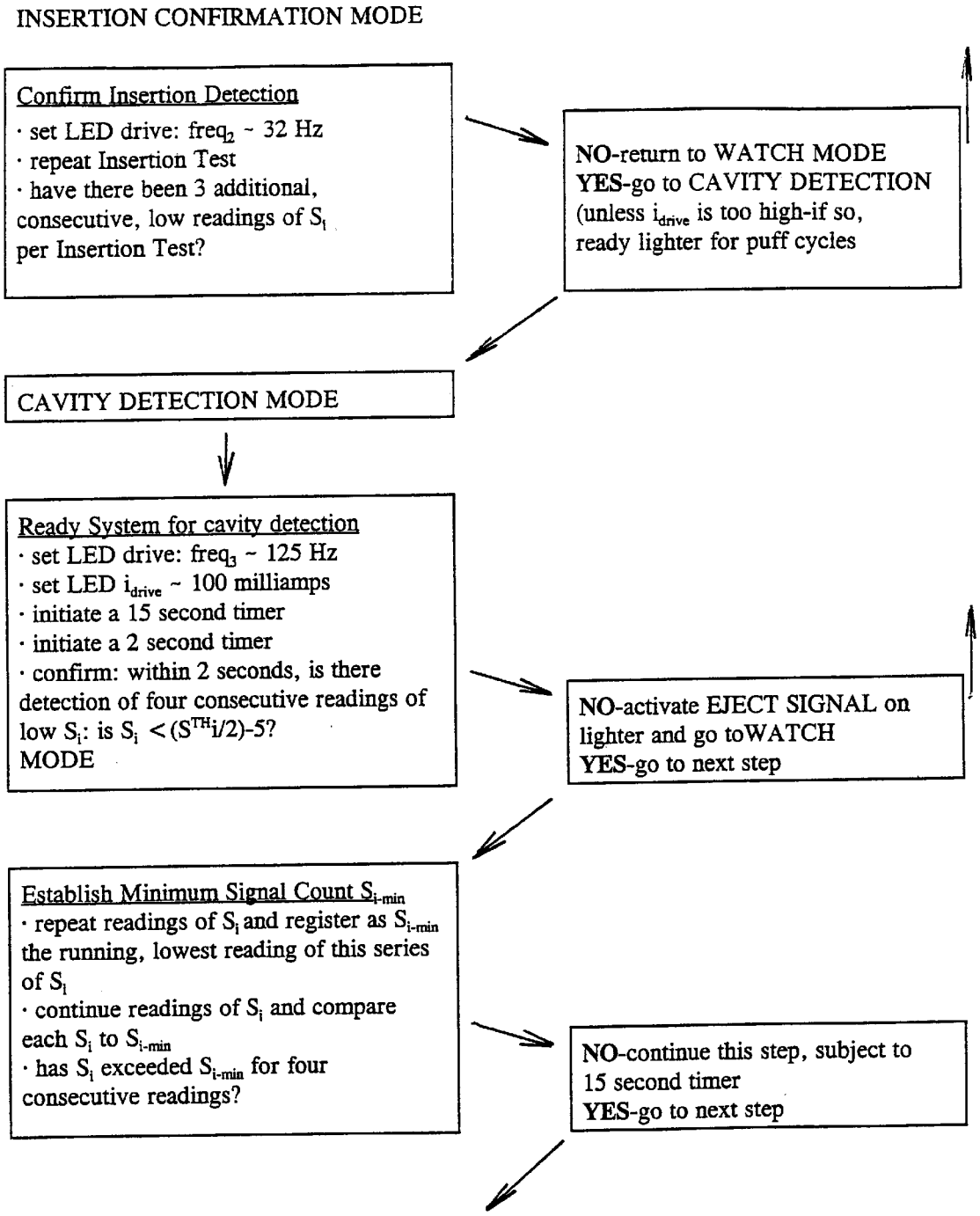
Figure 8C:
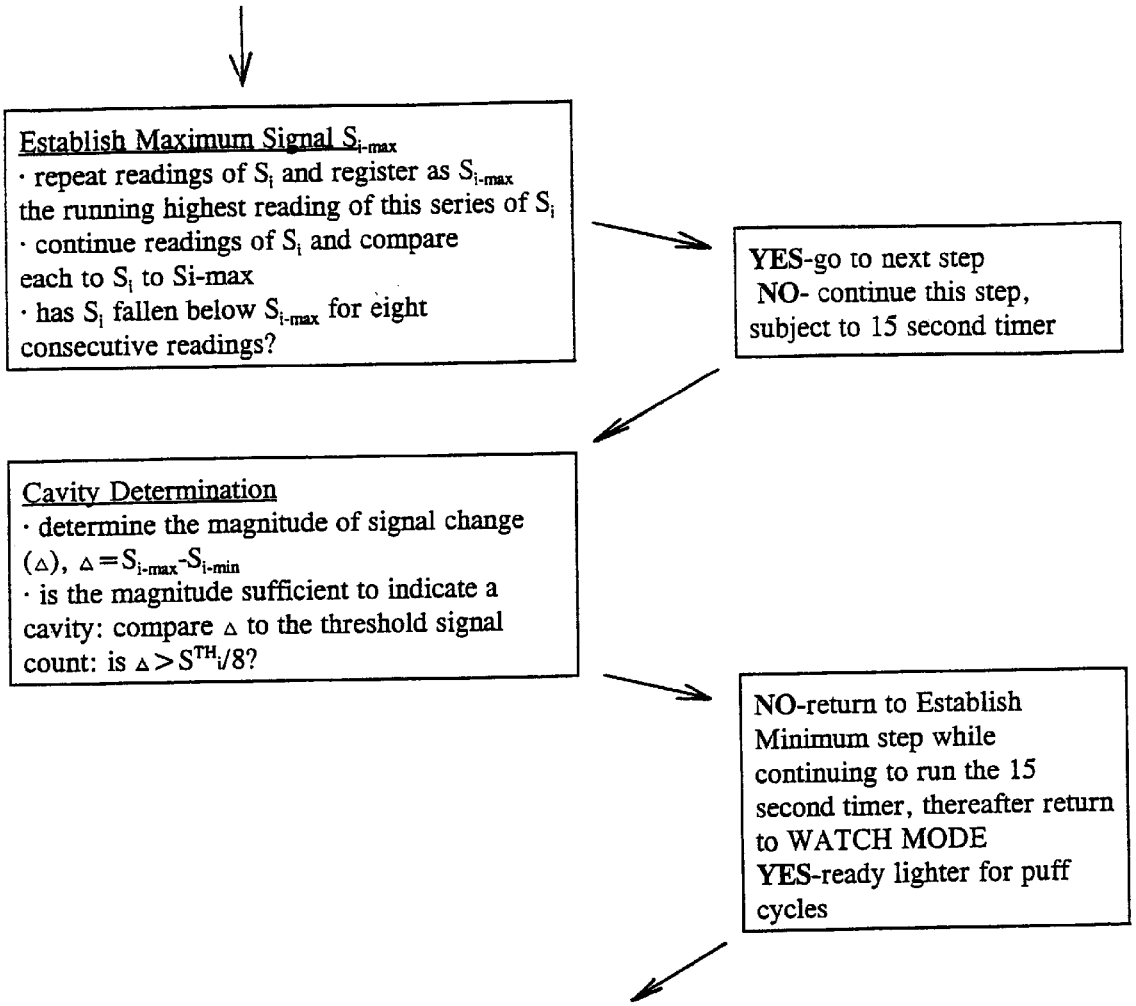

Referring to FIGS. 8A–C, the cigarette identifier system 50 is preferably operated in accordance with the following logic operations:

- a watch mode 400 as described previously wherein the lighter 25 has been turned on and the logic circuit drives the LED emitter 310 at a power-conserving level of 3 to 10 milliamps at 16 Hertz while the control logic continues to execute a test for a cigarette insertion;
- an insertion confirmation mode 420 wherein the control logic drives 195 the emitter 310 at a slightly higher frequency and the control circuit 195 repeats the insertion test such that it may confirm that indeed a cigarette insertion is underway; and
- a cavity detection mode 440 wherein the control circuit 195 executes a test to resolve whether a peak signal has occurred indicative of the presence of a cavity 90 in the cigarette being inserted in the heater fixture 39.

Referring particularly to FIG. 8A, the watch mode initiates with the step 402 of setting the LED emitter 310 to operate at a low power and frequency as described previously. At the same time, the logic circuit 195 executes the step 404 of establishing and updating a running average for a threshold signal count $S^{TH}_i$ as previously described in accordance with the following equation:

$$S^{TH}_i=(15/16)\cdot S^{TH}_{i-1}+(1/16)\cdot S_i$$

Also included within the watch mode is the step 406 of normalizing the threshold signal count $S^{TH}_i$ to a predetermined value such as a 75 digital count out of the typical digital range 0 to 255 as previously described by incrementally changing the drive current ($i_{LED}$) until the output of the photo-amplifier 350 is approximately the desired predetermined value.

The watch mode preferably includes a system check, wherein upon normalization, the logic circuit 195 checks (as indicated by $i_{LED}$ or an equivalent) the amount of power necessary to normalize the output signal of the photo-amplifier. The test in effect ascertains whether the cigarette identifier system 50 is being overdriven just to maintain the threshold signal count as a result of excessive dirt and/or condensates upon the lens 328, 332 of the system 50. Accordingly, this system check is, in effect, a check upon the cleanliness of the lens 328, 332. If they are too dirty, the system 50 may not function properly in executing the steps for recognizing the peak signal jump as expected from a cigarette bearing a cavity 90.

Accordingly, if the signal test indicates that the system 50 is dirty (that $i_{drive}$ for the LED is over 70 percent of maximum) the logic circuit 195 sets itself such that it forgoes execution of the cavity detection mode and will ready the lighter for puff actuation solely upon readings obtained from insertion detection 410 and the confirmation mode 420.

Preferably, through the watch mode 400, the logic circuit 195 continues to execute an insert detection test 410, preferably with each generation of $S_i$, whether the value $S_i$ has dropped significantly. In the preferred embodiment, this check is undertaken in accordance with the following digital analysis:

$$\text{is } S_i<[(S^{TH}_i/2)-5]?$$

If $S_i$ has a lesser value, the logic circuit fixes the value of $S^{TH}_i$ to its current value (at or near the time insertion is first detected) and enters the insertion confirmation mode 420, wherein during a step 422 the LED emitter 310 is set at a higher frequency, preferably at approximately 32 cycles per second, and the insertion test is repeated to resolve whether there have been 3 additional, consecutive low readings of $S_i$ in accordance with the insertion test 410. If so, and if the system 50 has not failed the system check 408, the logic circuit 195 enters the cavity detection mode 420. If the original low signal ($S_i$) and three additional, consecutive low readings of $S_i$ are not registered, then the system returns to the watch mode 400.

Upon entering the cavity detection mode, the logic circuit 195 executes the step 424 of adjusting upwardly the drive current $i_{LED}$ to approximately 100 milliamps at a frequency of 125 hertz. The logic circuit 195 also initiates a 15 second timer and 2 second timer, and then confirms whether within 2 seconds there is detection of four more consecutive readings of low $S_i$. If such is not detected, the logic circuit 195 preferably activates an eject signal on the lighter interface and directs the cigarette identifier system to reenter the watch mode. If it passes the test, it executes the next step 426 of establishing a minimum signal count $S_{i-min}$, wherein the logic circuit repeats readings $S_i$ and registers of those the lowest value until such time that the readings of four consecutive readings $S_i$ exceed $S_{i-min}$.

Thereupon the logic circuit preferably enters a step 428 of establishing a maximum signal count $S_{i-max}$ by continuing to take readings of $S_i$ and registering as $S_{i-max}$ the running highest reading. This continuation of readings is continued until $S_i$ has fallen below $S_{i-max}$ for eight consecutive readings.

Thereupon the logic circuit 195 executes a cavity determination step 430 wherein the signal change represented by the difference of $S_{i-max} - S_{i-min}$ is compared to a proportion of the threshold signal count, preferably in accordance with the following test:

is $\Delta > (S^{TH}{}_i)/8$?;wherein $\Delta = S_{i-max} - S_{i-min}$

If the difference is greater than the proportion of the threshold signal count, then a peak signal representing the presence of a cavity is in receipt, the inserted product is identified as being one with a cavity 90 and the lighter is readied for puff cycle operation.

If the magnitude of difference is insufficient to meet the test, or if the 15 second timer lapses, the system returns to watch mode. Whenever the logic circuit 195 ' returns to the watch mode, it reinitiates the updating of the signal count $S^{TH}{}_i$.

While this invention has been illustrated and described in accordance with preferred embodiments, it is recognized that variations and changes may be made therein without departing from the invention as encompassed in the claims. Although the above described logic sequence and tests of the cigarette identifier system are preferred, one skilled in the pertinent art would readily realize, upon familiarization with this disclosure, that other comparable logic sequences and tests may be constructed having entirely different values from those specifically provided above, yet by their proportions of values and other similarities provide functionally comparable effects, including provision for detecting a non-uniformity in infrared transmissivity at a location along a cigarette as has been taught herein. It is also contemplated that the invention may be applied to infrared transmissivity signatures other than those associated with a cavity within a partially-filled cigarette.

What is claimed is:

1. An electrical smoking system comprising a lighter and a cigarette:

said cigarette characterized by a predetermined non-uniformity in infrared transmissivity at a location along said cigarette;

said lighter comprising a cigarette-receiving receptacle and a cigarette identifier having a capacity to detect said predetermined non-uniformity in infrared transmissivity respective of a cigarette placed in said cigarette-receiving receptacle, said cigarette identifier comprising a source of infrared emission at a location along said cigarette-receiving receptacle and an infrared detector in cooperation with said source so that an output of said detector is indicative of infrared transmissivity across said location;

said lighter further comprising a controller in communication with said detector, said controller configured to execute a routine for detecting said non-uniformity in infrared transmissivity responsively to said output of said detector as a cigarette is inserted in said receptacle;

said controller further configured to enable execution of a power cycle of said lighter upon detection of said non-uniformity in infrared transmissivity.

2. A lighter of an electrical smoking system, said lighter comprising a cigarette-receiving receptacle and a cigarette identifier having a capacity to detect a predetermined non-uniformity in infrared transmissivity of a cigarette being placed in said cigarette-receiving receptacle;

said cigarette identifier comprising a source of infrared emission at a location along said cigarette-receiving receptacle and an infrared detector in cooperation with said source such that an output of said detector is indicative of infrared transmissivity across said location;

said lighter further comprising a controller in communication with said detector, said controller configured to execute a routine for detecting said predetermined non-uniformity in infrared transmissivity responsively to said output of said detector as a cigarette is inserted in said receptacle;

said controller further configured to enable execution of a power cycle of said lighter upon detection of said predetermined non-uniformity.

3. The lighter as claimed in claim 1 or 2, wherein said source of infrared emission and said infrared detector are in opposing relation at said location along said cigarette-receiving receptacle.

4. The lighter as claimed in claim 3, wherein said cigarette-receiving receptacle includes a receiver having a port arranged to slidingly receive a cigarette, said source and said detector being operative across said port.

5. A lighter of an electrical smoking system, said lighter comprising a cigarette-receiving receptacle and a cigarette identifier having a capacity to detect a predetermined non-uniformity in infrared transmissivity of a cigarette placed in said cigarette-receiving receptacle;

said cigarette identifier comprising a source of infrared emission at a location along said cigarette-receiving receptacle and an infrared detector in opposing relation to said source so that an output of said detector is indicative of infrared transmissivity across said location;

wherein said cigarette identifier further comprises a controller in communication with said output of said detector, said controller configured to execute:

a first logic step of establishing a threshold count from said detector output when said cigarette-receiving receptacle is free of any cigarette;

a peak signal test comprising the steps of establishing a minimum signal value amongst a first portion of said detector output, establishing a maximum signal value amongst a second portion of said detector output and comparing a difference between said minimum signal value and maximum signal value to a third value derived from said threshold count.

6. The lighter as claimed in claim 5, wherein said third value is in the range of approximately 5 to 15% of said threshold count.

7. The lighter as claimed in claim 5, wherein said cigarette identifier further comprises a photo-amplifier arranged to amplify said detector output.

8. The lighter as claimed in claim 7, wherein, when said receptacle is free of any cigarette, said detector output includes a pulsed output portion responsive to infrared output of said source and an ambient output portion responsive to ambient infrared, said photo-amplifier configured to produce a signal gain operative upon said pulsed output portion in excess of gain operative upon said ambient output portion so as to suppress effects of ambient light upon said cigarette receiver.

9. The lighter as claimed in claim 8, wherein said signal gain operative upon said pulsed output portion is in the range of approximately 50 to 200.

10. The lighter as claimed in claim 8, wherein said signal gain operative upon said pulsed output portion is in the range of approximately 150 to 200.

11. The lighter as claimed in claim 7, wherein said cigarette identifier further comprises a current amplifier operative to communicate pulses of drive current to said infrared light emitting diode responsively to a drive output of said controller.

12. The lighter as claimed in claim 11, wherein said controller is configured to execute the step of deriving a signal $S_i$ from a difference of $R_1-R_2$ , wherein $R_1$ is indicative of an output of said photo-amplifier during a pulse of said drive current and $R_2$ is indicative of a second output of said photo-amplifier immediately outside of said pulse of said drive current.

13. The lighter as claimed in claim 12, wherein said threshold establishing step includes the step of resolving a threshold signal count $S^{TH}_i$ from a running average of signals $S_i$.

14. The lighter as claimed in claim 13, wherein said threshold establishing step includes the step resolving a threshold signal count $S^{TH}_i$ from a running average of a predetermined number x of signals $S_i$ in accordance with the following relationship:

$$S^{TH}_i=((x-1)/x))\cdot S^{TH}_{i-1}+(1/x)\cdot S^{TH}_i.$$

15. The lighter as claimed in claim 13, wherein said controller is further configured to execute normalization of said threshold signal count $S^{TH}_i$ to a predetermined value y by adjusting said drive output of said controller.

16. The lighter as claimed in claim 15, wherein said signals $S_i$ may range in signal value from 0 to 100 percentile, said predetermined value y being in the range of a 20 to 30 percentile portion of said range of signal values.

17. The lighter as claimed in claim 15, wherein said $S_i$ has an assigned signal value in the range of signal values of 0 to 100 percentile and said predetermined value y falls within the range of approximately 20 to 40 percentile.

18. The lighter as claimed in claim 17, wherein said predetermined value y falls within the range of approximately 25 to 35 percentile.

19. The lighter as claimed in claim 13, wherein said controller is configured to execute a system check in conjunction with said normalization step, said system check comprising the step of comparing said adjusted drive output of said normalization step to a predetermined maximum permissible value for said adjusted drive output;

said controller being configured to disable said peak signal test if said adjusted drive output of said normalization step exceeds said predetermined maximum permissible value for said adjusted drive output.

20. The lighter as claimed in claim 19, wherein step of comparing said adjusted drive output to a permissible value includes the step of said controller reading drive current $i_{drive}$ at said source, said predetermined maximum permissible value being assigned a value in the range of approximately 65 to 75 percent of a maximum possible value of $i_{drive}$.

21. The lighter as claimed in claim 19, wherein said controller is configured to execute a watch mode at a first drive current level and first frequency, said watch mode comprising:

said step of establishing a threshold count;

said peak signal test;

said step of normalizing said threshold count;

said system check; and an insertion detection test comprising the step of comparing said signal $S_i$ to a predetermined insertion test value, said insertion test value being less than said normalized threshold count, said controller configured to remain in said watch mode if $S_i$ remains above said insertion test value;

said controller being further configured to execute an insertion confirmation mode upon resolution that $S_i$ is below said insertion test value;

said insertion confirmation mode comprising the step of repeating said insertion detection test a predetermined number of times.

22. The lighter as claimed in claim 21, wherein said insertion test value is less than 50% of the established threshold count.

23. The lighter as claimed in claim 22, wherein said insertion test executes the following comparison:

$$\text{is } S_i<[(S^{TH}_i/2)-5,$$

wherein $S_i$ and $S^{TH}_i$ are digital numerics from 0 to 255.

24. The lighter as claimed in claim 19, wherein said controller is configured to execute a cavity detection mode at a second drive current and second frequency greater than said first drive current level and said first frequency, respectively, said watch mode comprising said peak signal test;

said controller configured to execute said cavity detection mode upon confirmation of insertion detection as a result of execution of said insertion confirmation mode;

said controller configured to ready said lighter for puff actuated operation upon detection of a cavity as a result of execution of said cavity detection mode or upon confirmation of insertion detection as a result of execution of said insertion confirmation mode when said peak signal test is disabled.

25. The lighter as claimed in claim 19, wherein said peak signal test includes a comparison between: (a) the difference between said maximum signal value and said minimum signal value; and (b) one of $S^{TH}_i$ or a predetermined fraction $S^{TH}_i$.

26. The lighter as claimed in claim 25, wherein said peak signal test includes the test:

$\Delta>(S^{TH}_i)/k$; wherein $\Delta$ is the difference between said maximum signal value and said minimum signal value and k is in the range of 2 to 12.

27. The lighter as claimed in claim 26, wherein said peak signal test includes the test:

$\Delta > (S^{TH}_{i})/8$; wherein $\Delta$ is the difference between said maximum signal value and said minimum signal value.

28. A lighter of an electrical smoking system, said lighter comprising a cigarette-receiving receptacle and a cigarette identifier, said cigarette identifier comprising:

optical components in communication with said receptacle;

an infrared source and infrared detector in cooperative relation with said optical components;

a controller adapted to execute:

a first routine for detecting an insertion of a cigarette in said receptacle;

a second routine for detecting a predetermined non-uniformity in infrared transmissivity of a partially-filled cigarette when a partially-filled cigarette is inserted in said receptacle;

a test routine for determining whether said optical components are too clouded for execution of said second routine; and a control logic sequence enabling a puff-actuated power cycle of the lighter pursuant to said second routine and alternatively, pursuant to said first routine if said second routine is disabled pursuant to said test routine.

* * * * *